US012624563B2

(12) United States Patent
Gershfeld et al.

(10) Patent No.: US 12,624,563 B2
(45) Date of Patent: May 12, 2026

(54) EARTHQUAKE ANCHOR

(71) Applicants: Mikhail Gershfeld, Fullerton, CA (US); Matthew Slazas, Nampa, ID (US); Michael Waggoner, Santa Ana, CA (US)

(72) Inventors: Mikhail Gershfeld, Fullerton, CA (US); Matthew Slazas, Nampa, ID (US); Michael Waggoner, Santa Ana, CA (US)

( * ) Notice: Subject to any disclaimer, the term of this patent is extended or adjusted under 35 U.S.C. 154(b) by 160 days.

(21) Appl. No.: 18/791,777

(22) Filed: Aug. 1, 2024

(65) Prior Publication Data

US 2026/0035948 A1 Feb. 5, 2026

(51) Int. Cl.

| | |
|---|---|
| ***E04H 9/02*** | (2006.01) |
| ***E02D 27/34*** | (2006.01) |
| ***E04B 1/26*** | (2006.01) |
| ***E04H 9/14*** | (2006.01) |

(52) U.S. Cl.

CPC ..... *E04H 9/027* (2013.01); *E02D 27/34* (2013.01); *E04B 1/26* (2013.01); *E04B 1/2604* (2013.01); *E04H 9/021* (2013.01); *E04H 9/14* (2013.01); *E04B 2001/268* (2013.01); *E04B 2001/2684* (2013.01)

(58) Field of Classification Search

CPC ..... E02D 27/34; E04B 1/26; E04B 1/2604; E04B 2001/268; E04B 2001/2684; E04H 9/14; E04H 9/021; E04H 9/027

See application file for complete search history.

(56) References Cited

U.S. PATENT DOCUMENTS

| | | | | | |
|---|---|---|---|---|---|
| 167,118 | A * | 8/1875 | Pritchett | F16B 12/2009 | 182/228.1 |
| 961,981 | A * | 6/1910 | Miller | E04B 1/2604 | 256/65.01 |
| 2,654,923 | A * | 10/1953 | Johnson | B65D 9/32 | 403/8 |
| 2,747,638 | A * | 5/1956 | Cederquist | F16B 39/02 | 411/991 |
| 4,133,151 | A * | 1/1979 | Burvall | E04B 1/26 | 403/171 |
| 4,484,430 | A * | 11/1984 | Rossman | E04B 1/2604 | 403/174 |
| 4,728,215 | A * | 3/1988 | Martincic | F16B 12/2036 | 403/231 |
| 5,051,047 | A * | 9/1991 | Loncaric | B60R 9/00 | 411/21 |
| 5,570,549 | A * | 11/1996 | Lung | E04G 21/12 | 52/92.1 |
| 5,694,732 | A * | 12/1997 | Wilbert | E04C 3/42 | 248/248 |
| 5,934,819 | A * | 8/1999 | Mangold | E06B 3/9845 | 411/522 |
| 5,987,828 | A * | 11/1999 | Hardy | E04H 9/14 | 52/293.3 |

(Continued)

*Primary Examiner* — Jessie T Fonseca

(74) *Attorney, Agent, or Firm* — Vladi Khiterer

(57) ABSTRACT

An earthquake anchor for a mass plywood panel has a replaceable fuse plate clamped between two members embedded into the mass plywood panel and anchored to the floor or foundation. The fuse plate deforms in an earthquake but keeps the mass plywood panel intact. The deformed fuse plate is then replaced with a new fuse plate.

2 Claims, 11 Drawing Sheets

(56) References Cited

U.S. PATENT DOCUMENTS 6,050,033 A * 4/2000 Wrightman ..... E04C 3/42 52/92.1
6,158,188 A * 12/2000 Shahnazarian ..... E04B 1/2604 52/702
6,195,949 B1 * 3/2001 Schuyler ..... E04C 5/12 52/223.13
6,616,390 B1 * 9/2003 Feilner ..... F16B 43/00 411/917
6,663,314 B2 * 12/2003 Bequet ..... B64C 3/28 403/408.1
7,159,288 B2 * 1/2007 Van De Loo ..... F16B 12/32 29/238
7,168,343 B2 * 1/2007 Leek ..... B25B 17/00 52/704
7,824,125 B2 * 11/2010 Dorney ..... F16B 5/0291 312/265.5
8,777,509 B2 * 7/2014 Couffignal ..... F16B 7/0433 411/389
2003/0230032 A1 * 12/2003 Shahnazarian ..... E04H 9/14 52/223.13
2004/0182016 A1 * 9/2004 Locke ..... E04B 1/22 52/79.13
2005/0055897 A1 * 3/2005 Commins ..... E04H 9/14 52/169.1
2009/0107082 A1 * 4/2009 Commins ..... E04H 9/14 52/745.12
2011/0041449 A1 * 2/2011 Espinosa ..... E02D 35/00 52/698
2012/0180423 A1 * 7/2012 Avila ..... E04H 9/021 52/700
2019/0345710 A1 * 11/2019 Espinosa ..... E04B 1/2604
2021/0189716 A1 * 6/2021 Brekke ..... E04B 1/2608
2023/0110886 A1 * 4/2023 Abela ..... E04H 9/024 52/167.1
2023/0417042 A1 * 12/2023 Mahrenholtz ..... E04B 1/2403

* cited by examiner

EARTHQUAKE ANCHOR

FIELD OF THE INVENTION

This invention pertains to earthquake anchors, specifically the earthquake or wind anchors for Mass Plywood Panels (MPPs) or other solid panels.

BACKGROUND OF THE INVENTION

MPPs are engineered wood panels composed of multiple layers of wood veneers, bonded together with adhesives in cross-laminated configuration. The use of MPPs offers a number of benefits in construction. MPPs exhibit superior strength and stiffness properties compared to traditional timber products, making them suitable for use in load-bearing structures such as walls, floors, and roofs. MPPs' cross-laminated construction provides dimensional stability, reducing the risk of warping, shrinking, or swelling, thus ensuring long-term structural stability. Further, MPPs facilitate rapid and cost-effective construction process due to their large panel sizes and prefabricated nature. The ability to manufacture MPPs in customizable dimensions allows for precise fitting and assembly on-site, minimizing material wastage and labor expenses. The lightweight nature of MPPs simplifies transportation and handling, leading to accelerated project timelines and reduced construction downtime.

Be that as it may, the buildings constructed with MPPs are vulnerable to earthquake or wind forces as structures built with any other construction materials. What is needed is an earthquake anchor specifically suited for MPPs.

SUMMARY OF THE INVENTION

The present invention satisfies this need. The earthquake anchor according to this invention comprises a fuse plate clamped between two C-shaped members embedded into the MPP. The purpose of the fuse plate is to provide the lateral load resisting system a ductile response and load path that will improve performance of the lateral load resisting system.

The fuse plate is anchored through the floor to the wall below or to the foundation. Earthquake forces deform the fuse plate, leaving the MPP intact. The fuse plate is then replaced with a new fuse plate. After the fuse plate deforms, the C-shaped members are still capable of transferring tension forces, thus providing secondary defense against failure.

BRIEF DESCRIPTION OF THE DRAWING FIGURES

DETAILED DESCRIPTION OF THE PREFERRED EMBODIMENT

This invention will be better understood with reference to FIG. 1 through FIG. 10. The same numerals indicate the same elements in all drawing figures.

Figure 1:
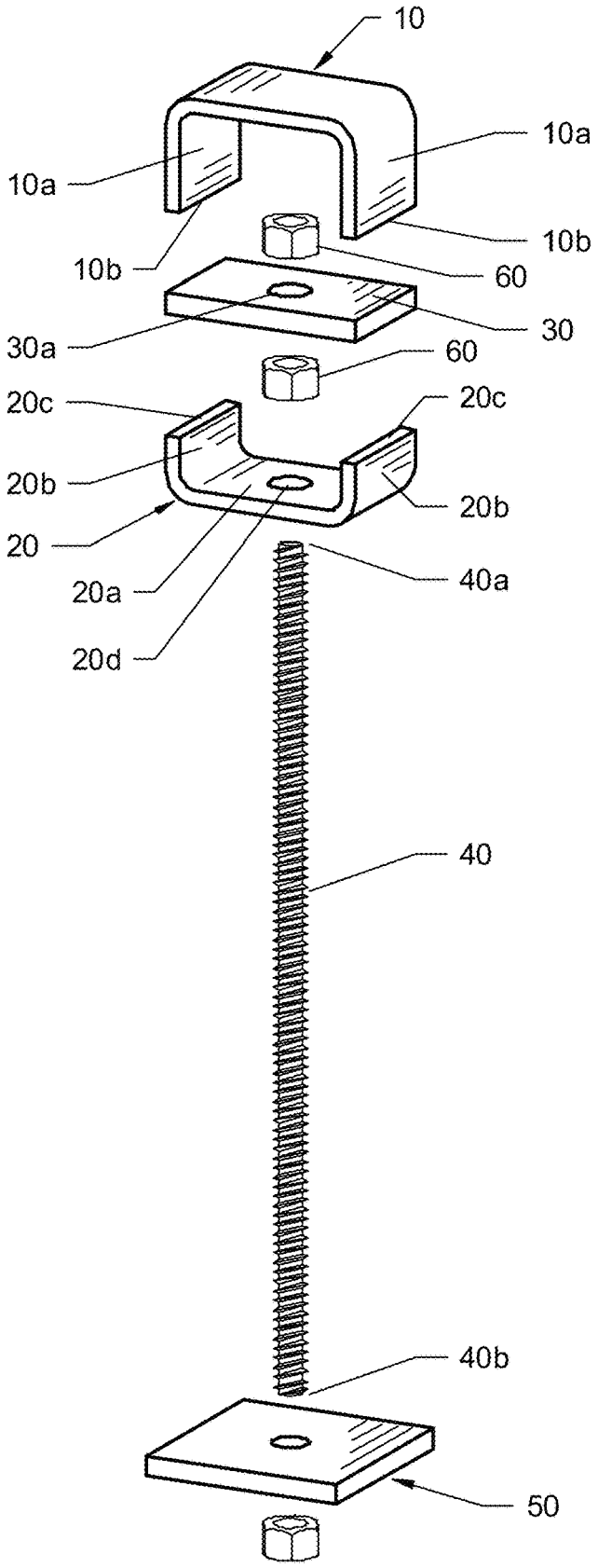
FIG. 1 shows an exploded isometric view of an earthquake anchor according to the first embodiment of this invention.
Figure 2:
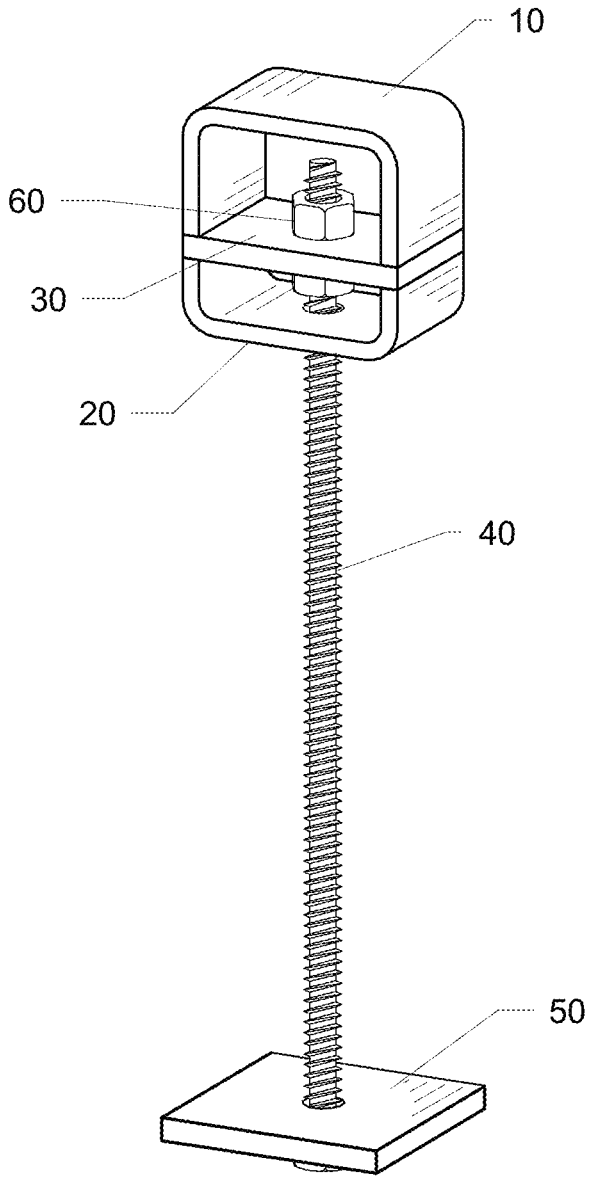
FIG. 2 shows an isometric view of an earthquake anchor according to the first embodiment of this invention.

Viewing, simultaneously, FIG. 1 and FIG. 2, numeral 10 indicates a top C-shaped member. Top C-shaped member 10 comprises downward arms indicated by numeral 10*a*. Downward arms 10*a* terminate in downward facing flanges indicated by numeral 10*b*.

Numeral 20 indicates a bottom C-shaped member. Bottom C-shaped member 20 comprises a base indicated by numeral 20*a* and upward arms indicated by numeral 20*b*. Upward arms 20*b* terminate in upward facing flanges indicated by numeral 20*c*.

Figure 11:
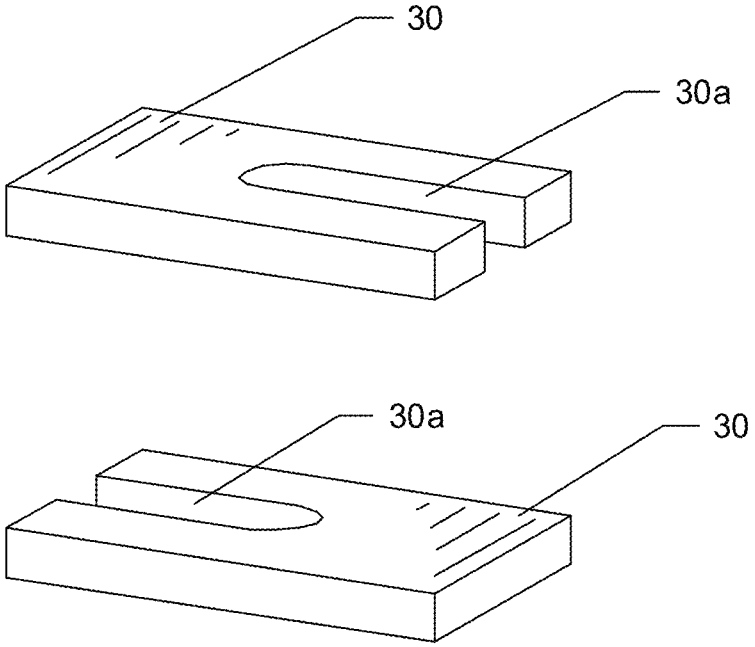
FIG. 11 shows an exploded isometric view of fuse plates according to an alternative embodiment of this invention.

Numeral 30 indicates a fuse plate. Fuse plate 30 is clamped between downward facing flanges 10*b* and upward facing flanges 20*c*. Fuse plate 30 is disposed substantially parallel to the floor, such that top C-shaped member 10, bottom C-shaped member 20 and fuse plate 30 form a substantially rectangular frame in this embodiment of the invention. The preferred embodiment shows one fuse plate 30, however, several fuse plates 30 can be stacked one on top of the other as shown in FIG. 11.

Numeral 40 indicates a threaded bolt. Threaded bolt 40 comprises a proximate end indicated by numeral 40*a* and a distal end indicated by numeral 40*b*. Distal end 40*b* is affixed to a floor by way of attachment means indicated by numeral 50. Threaded bolt 40 is disposed substantially perpendicularly to the floor.

Figure 3:
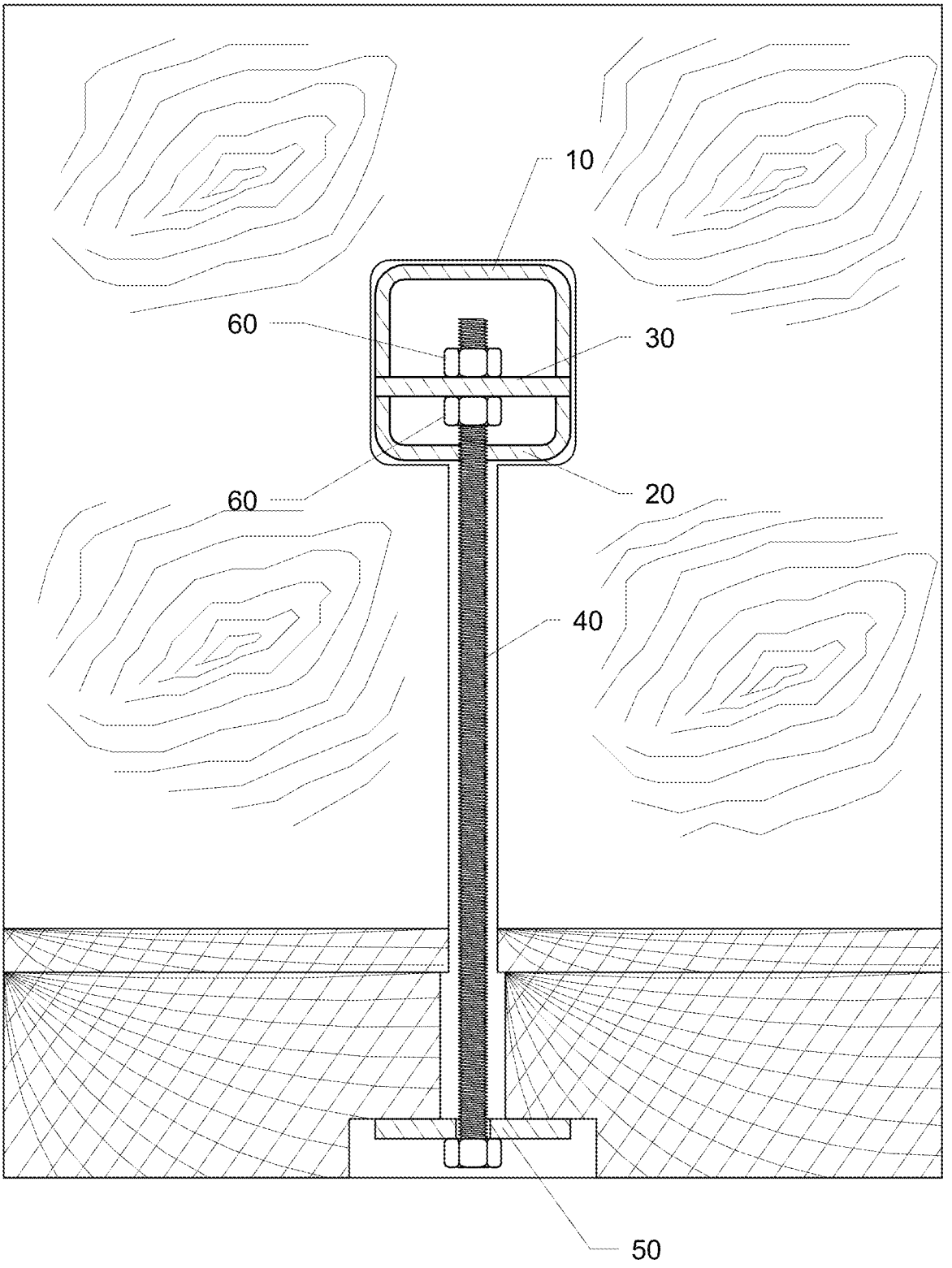
FIG. 3 shows an elevation view of an earthquake anchor according to the first embodiment of this invention installed in an MPP.

Viewing now FIG. 3, the frame formed by top C-shaped member 10, bottom C-shaped member 20 and fuse plate 30 is configured to be mounted in a rectangular opening formed in the mass plywood panel, the frame adapted to snugly fit therein. Threaded bolt 40 is configured to be inserted in a vertical bore formed in the mass plywood panel, the vertical bore communicating with the rectangular opening.

Viewing again, simultaneously, FIG. 1 and FIG. 2, fuse plate 30 comprises a first opening indicated by numeral 30*a*. First opening 30*a* is disposed substantially in the middle of fuse plate 30. Base 20*a* comprises a second opening indicated by numeral 20*d*. First opening 30*a*, second opening 20*d* and the vertical bore are aligned. First opening 30*a* and second opening 20*d* receive proximal end 40*a*.

In the preferred embodiment, first opening 30*a* is shown as round hole. However, first opening 30*a* can be an elongated slot as shown in FIG. 11.

Numeral 60 indicates a nut. A pair of nuts 60 are threaded on threaded bolt 40 and disposed on either side of fuse plate 30, abutting fuse plate 30.

In the preferred embodiment shown in FIG. 1 through FIG. 5, top C-shaped member 10 is larger (i.e. it has longer downward arms 10*a*) than bottom C-shaped member 20 (which has shorter upward arms 20*b* than downward arms 10*a*). This is done for the convenience of assembly and removal of fuse plate 30.

Figure 4:
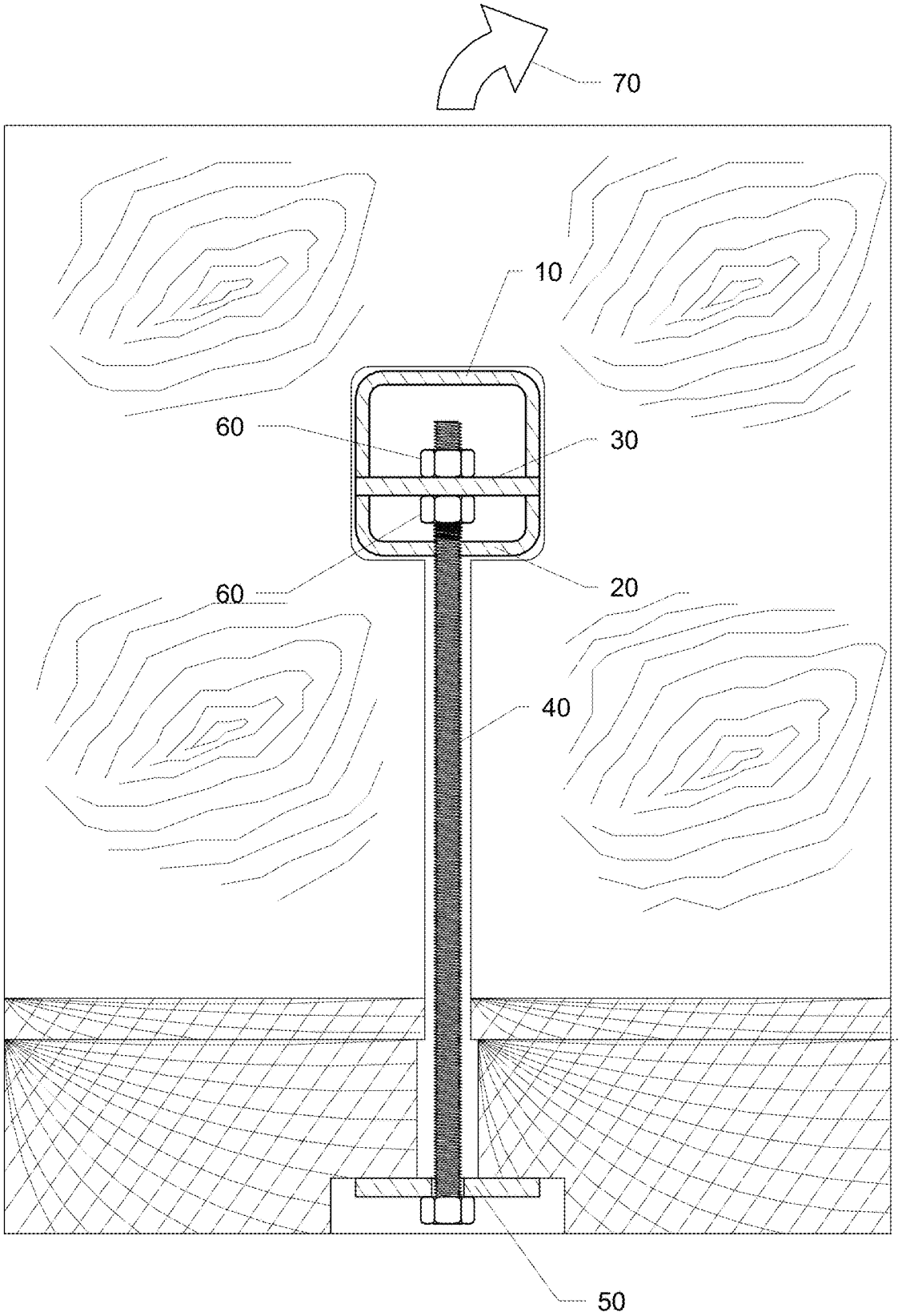
FIG. 4 shows an elevation view of an earthquake anchor according to the first embodiment of this invention installed in the MPP, with an earthquake force acting on the MPP.
Figure 5:
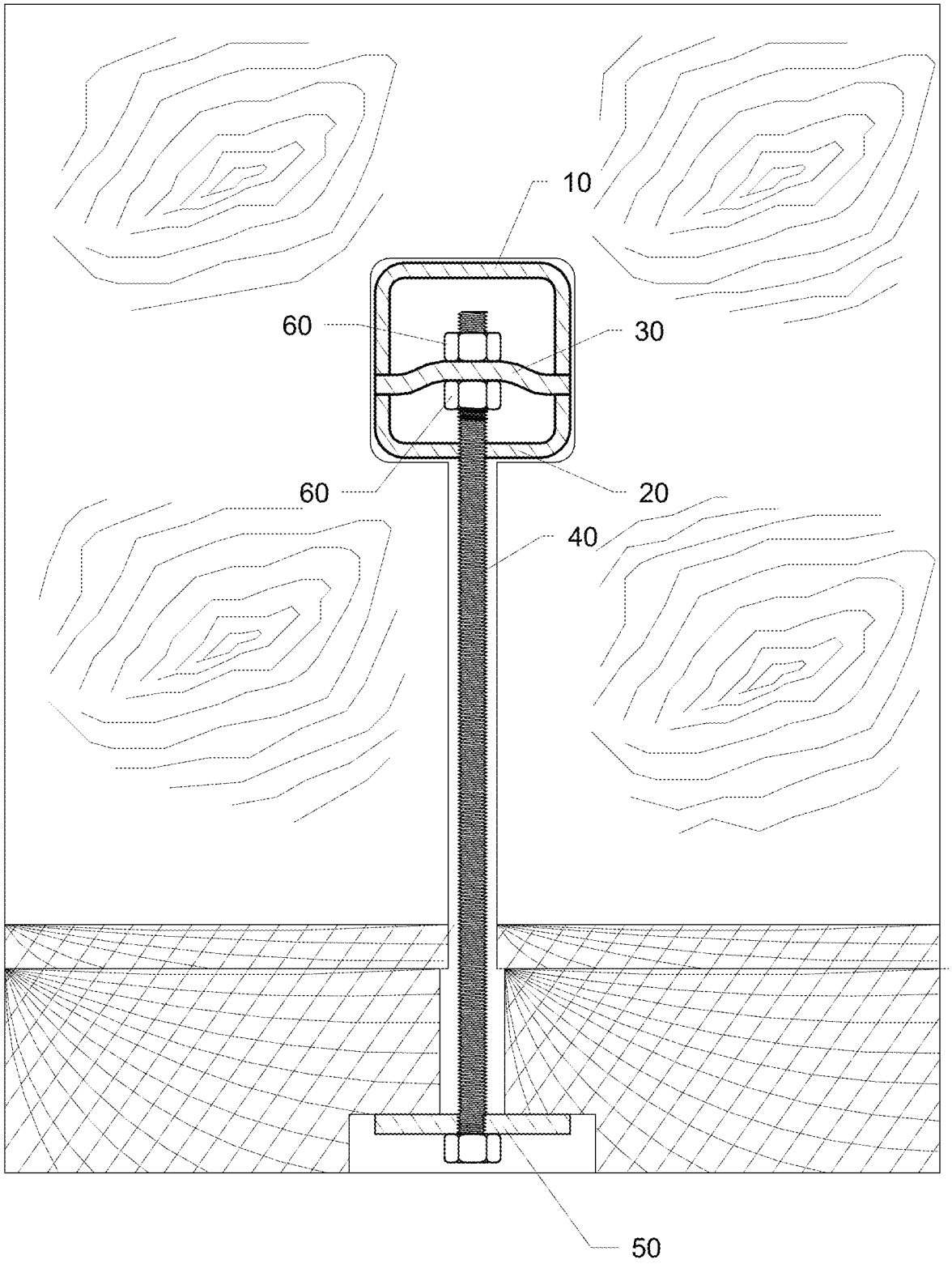
FIG. 5 shows an elevation view of an earthquake anchor according to the first embodiment of this invention installed in the MPP, with a fuse plate deformed by the earthquake force.

Viewing now FIG. 4, numeral 70 indicates the force of earthquake acting upon the mass plywood panel. Viewing now FIG. 5, fuse plate 30 is shown deformed as a result of the force of earthquake 70, while the mass plywood panel remains intact. The deformed fuse plate 30 would be removed and replaced with a new fuse plate 30.

The second embodiment of this invention shown in FIG. 6 through FIG. 10 is identical to the first embodiment shown in FIG. 1 through FIG. 5, except the shape of the frame formed by top C-shaped member 10, bottom C-shaped member 20 and fuse plate 30 is circular rather than rectangular.

Figure 6:
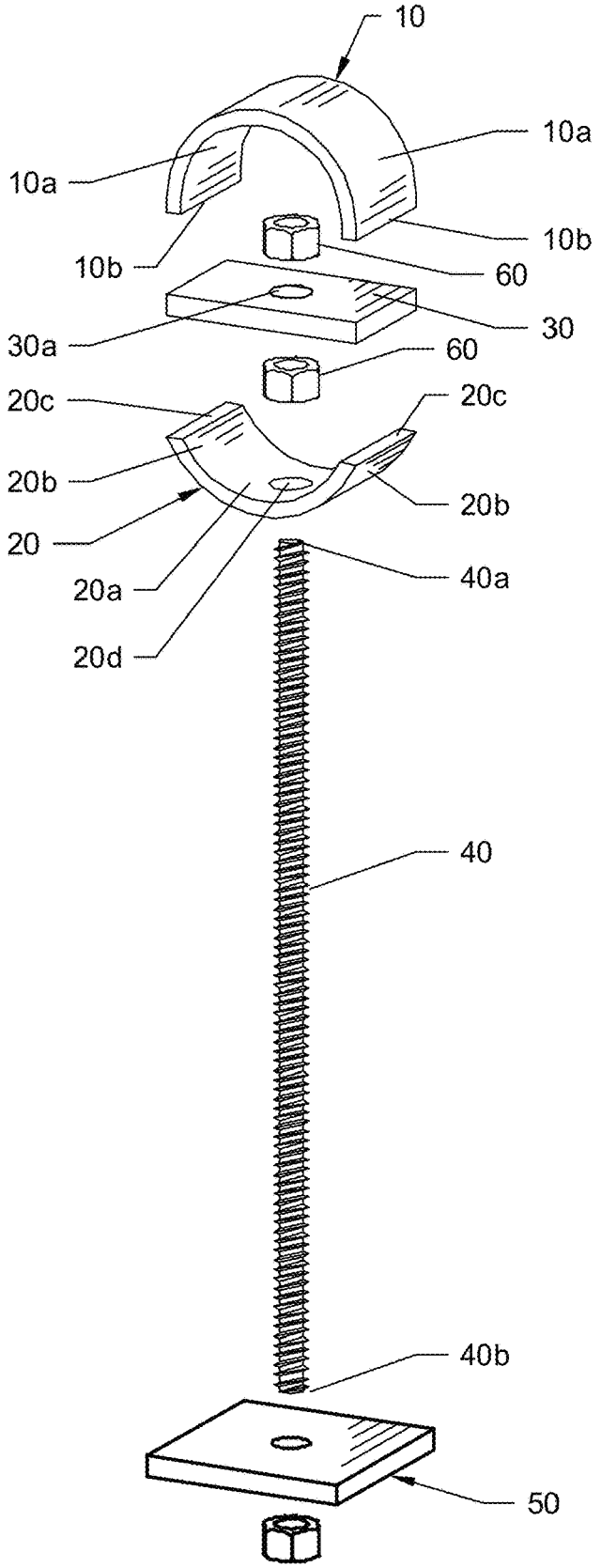
FIG. 6 shows an exploded isometric view of an earthquake anchor according to the second embodiment of this invention.
Figure 7:
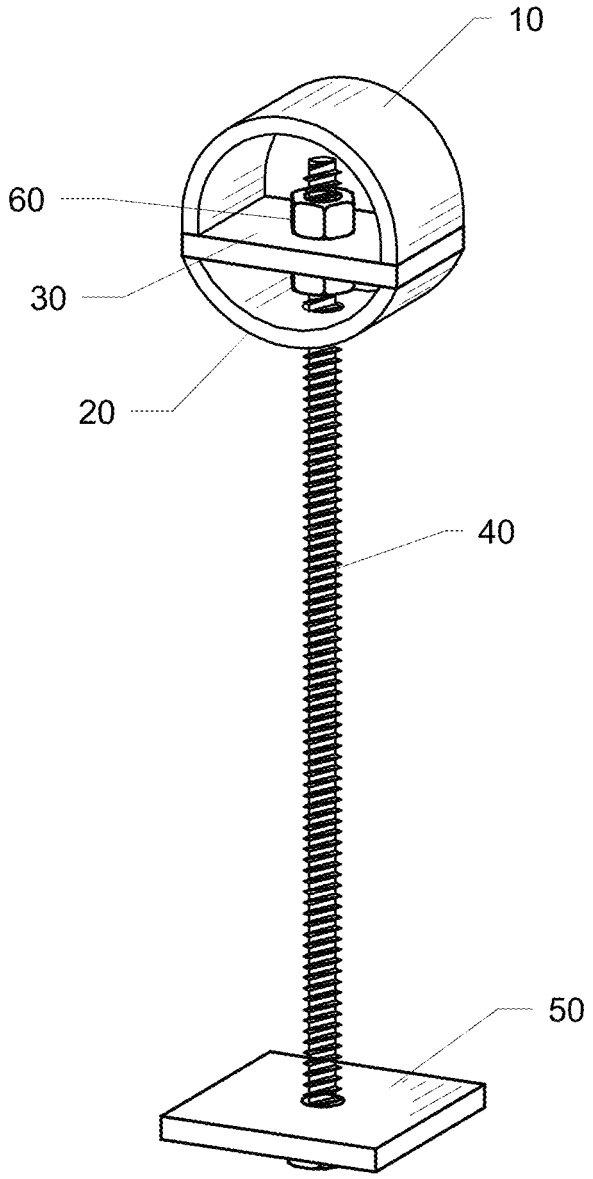
FIG. 7 shows an isometric view of an earthquake anchor according to the second embodiment of this invention.

Specifically, viewing, simultaneously, FIG. 6 and FIG. 7, numeral 10 indicates a top C-shaped member. Top C-shaped member 10 comprises downward arms indicated by numeral 10*a*. Downward arms 10*a* terminate in downward facing flanges indicated by numeral 10*b*.

Numeral 20 indicates a bottom C-shaped member. Bottom C-shaped member 20 comprises a base indicated by numeral 20*a* and upward arms indicated by numeral 20*b*. Upward arms 20*b* terminate in upward facing flanges indicated by numeral 20*c*.

Numeral 30 indicates a fuse plate. Fuse plate 30 is clamped between downward facing flanges 10*b* and upward facing flanges 20*c*. Fuse plate 30 is disposed substantially parallel to the floor, such that top C-shaped member 10, bottom C-shaped member 20 and fuse plate 30 form a substantially circular frame in this embodiment of the invention. The preferred embodiment shows one fuse plate 30, however, several fuse plates 30 can be stacked one on top of the other as shown in FIG. 11.

Numeral 40 indicates a threaded bolt. Threaded bolt 40 comprises a proximate end indicated by numeral 40*a* and a distal end indicated by numeral 40*b*. Distal end 40*b* is affixed to a floor by way of attachment means indicated by numeral 50. Threaded bolt 40 is disposed substantially perpendicularly to the floor.

Figure 8:
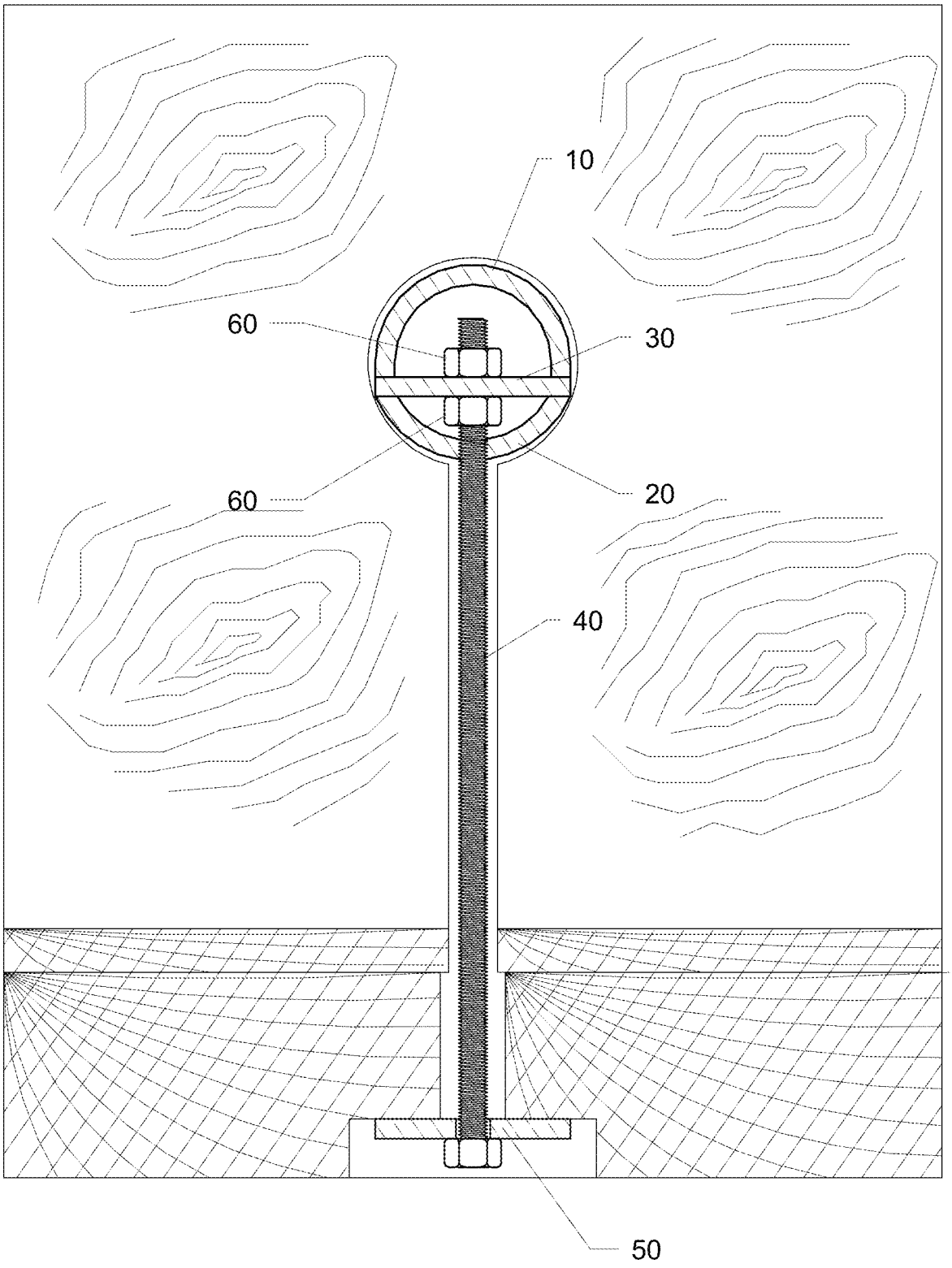
FIG. 8 shows an elevation view of an earthquake anchor according to the second embodiment of this invention installed in an MPP.

Viewing now FIG. 8, the frame formed by top C-shaped member 10, bottom C-shaped member 20 and fuse plate 30 is configured to be mounted in a rectangular opening formed in the mass plywood panel, the frame adapted to snugly fit therein. Threaded bolt 40 is configured to be inserted in a vertical bore formed in the mass plywood panel, the vertical bore communicating with the rectangular opening.

Viewing again, simultaneously, FIG. 6 and FIG. 7, fuse plate 30 comprises a first opening indicated by numeral 30*a*. First opening 30*a* is disposed substantially in the middle of fuse plate 30. Base 20*a* comprises a second opening indicated by numeral 20*d*. First opening 30*a*, second opening 20*d* and the vertical bore are aligned. First opening 30*a* and second opening 20*d* receive proximal end 40*a*.

In the preferred embodiment, first opening 30*a* is shown as round hole. However, first opening 30*a* can be an elongated slot as shown in FIG. 11.

Numeral 60 indicates a nut. A pair of nuts 60 are threaded on threaded bolt 40 and disposed on either side of fuse plate 30, abutting fuse plate 30.

In the preferred embodiment shown in FIG. 6 through FIG. 10, top C-shaped member 10 is larger (i.e. it has longer downward arms 10*a*) than bottom C-shaped member 20 (which has shorter upward arms 20*b* than downward arms 10*a*). This is done for the convenience of assembly and removal of fuse plate 30.

Figure 9:
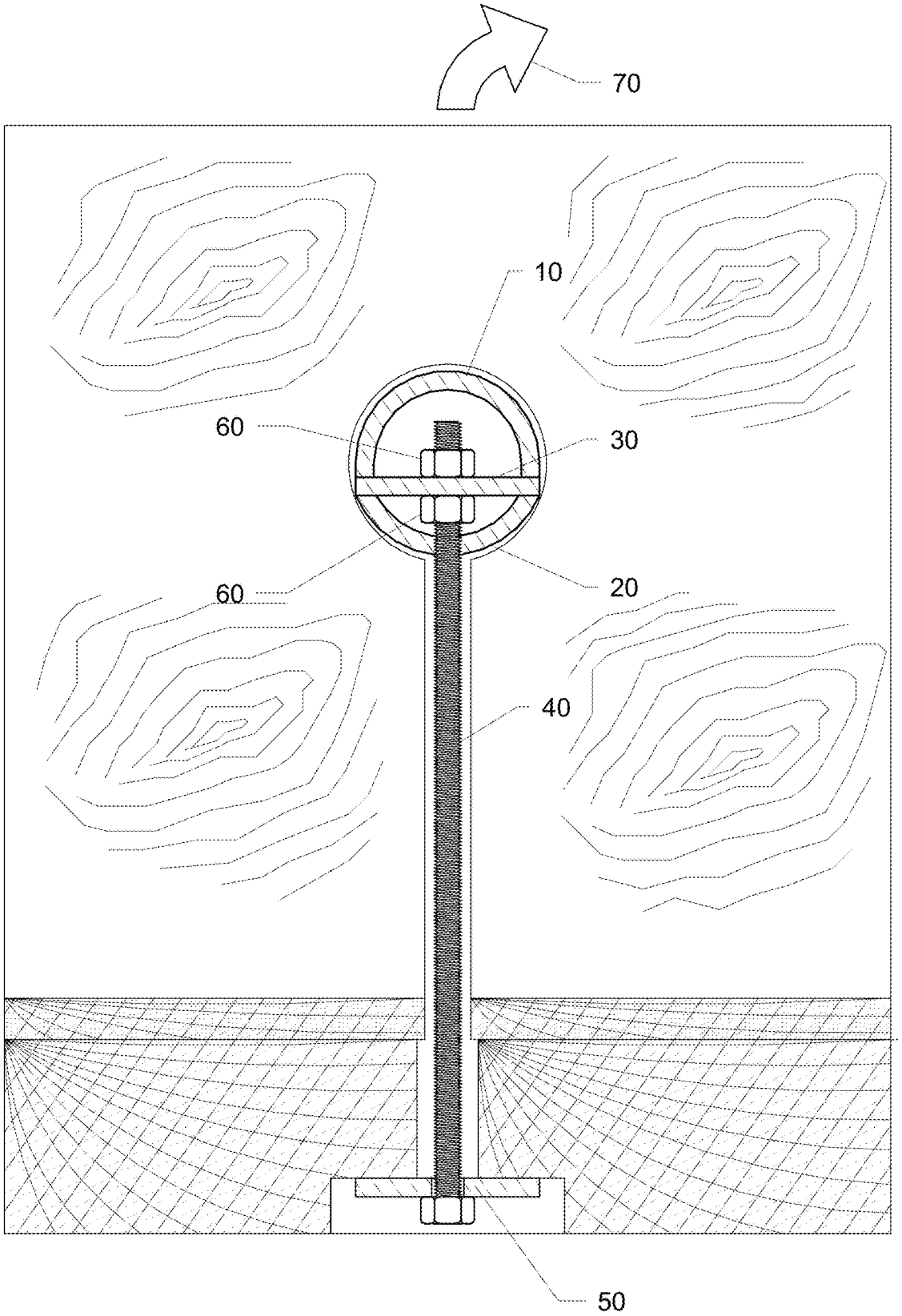
FIG. 9 shows an elevation view of an earthquake anchor according to the second embodiment of this invention installed in the MPP, with an earthquake force acting on the MPP.
Figure 10:
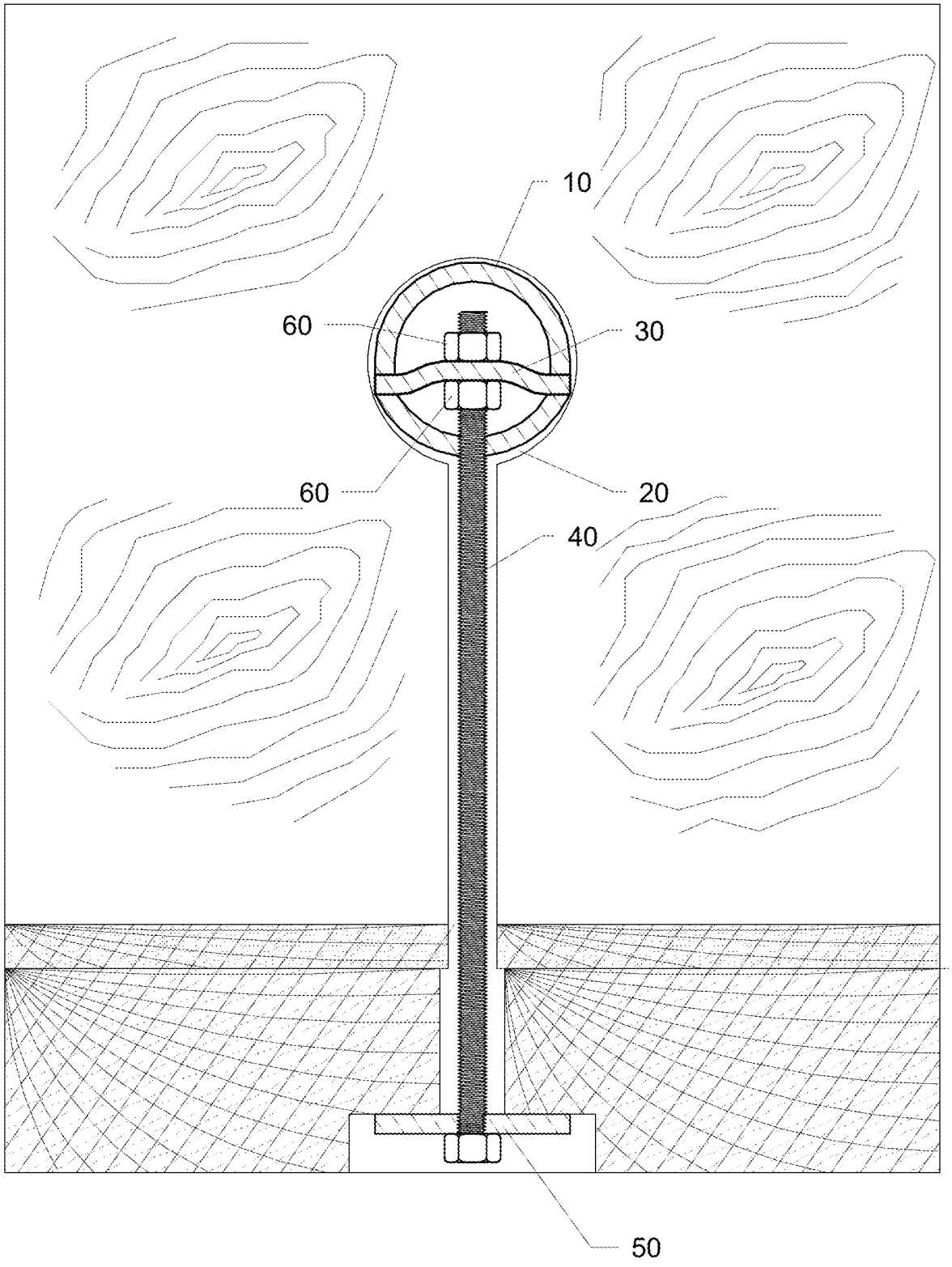
FIG. 10 shows an elevation view of an earthquake anchor according to the second embodiment of this invention installed in the MPP, with a fuse plate deformed by the earthquake force.

Viewing now FIG. 9, numeral 70 indicates the force of earthquake acting upon the mass plywood panel. Viewing now FIG. 10, fuse plate 30 is shown deformed as a result of the force of earthquake 70, while the mass plywood panel remains intact. The deformed fuse plate 30 would be removed and replaced with a new fuse plate 30.

While the present invention has been described and defined by reference to the preferred embodiment of the invention, such reference does not imply a limitation on the invention, and no such limitation is to be inferred. The invention is capable of considerable modification, alteration, and equivalents in form and function, as will occur to those ordinarily skilled and knowledgeable in the pertinent arts. The depicted and described preferred embodiment of the invention is exemplary only, and is not exhaustive of the scope of the invention. Consequently, the invention is intended to be limited only by the spirit and scope of the appended claims, giving full cognizance to equivalents in all respects.

We claim:

1. An earthquake anchor for a mass plywood panel comprising:

a top C-shaped member comprising downward arms terminating in downward facing flanges;

a bottom C-shaped member comprising a base and upward arms terminating in upward facing flanges;

at least one fuse plate clamped between the downward facing flanges and the upward facing flanges, the at least one fuse plate disposed substantially parallel to a floor, such that the top C-shaped member, the bottom C-shaped member and the at least one fuse plate form a substantially rectangular frame;

a threaded bolt comprising a proximate end and a distal end, the distal end affixed to the floor by way of attachment means, the threaded bolt disposed substantially perpendicularly to the floor;

wherein the substantially rectangular frame configured to be mounted in a rectangular opening formed in the mass plywood panel, the substantially rectangular frame adapted to snugly fit therein; wherein the threaded bolt configured to be inserted in a vertical bore formed in the mass plywood panel, the vertical bore communicating with the rectangular opening;

wherein the at least one fuse plate comprising a first opening disposed substantially in the middle of the at least one fuse plate;

wherein the base comprising a second opening, such that the first opening, the second opening and the vertical bore are aligned, the first opening and the second opening receiving the proximal end;

wherein a pair of nuts threaded on the threaded bolt and disposed on either side of the at least one fuse plate abutting the at least one fuse plate.

2. An earthquake anchor for a mass plywood panel comprising:

a top C-shaped member comprising downward arms terminating in downward facing flanges;

a bottom C-shaped member comprising a base and upward arms terminating in upward facing flanges;

at least one fuse plate clamped between the downward facing flanges and the upward facing flanges, the at least one fuse plate disposed substantially parallel to a floor, such that the top C-shaped member, the bottom C-shaped member and the at least one fuse plate form a substantially circular frame;

a threaded bolt comprising a proximate end and a distal end, the distal end affixed to the floor by way of attachment means, the threaded bolt disposed substantially perpendicularly to the floor;

wherein the substantially circular frame configured to be mounted in a circular opening formed in the mass plywood panel, the substantially circular frame adapted to snugly fit therein;

wherein the threaded bolt configured to be inserted in a vertical bore formed in the mass plywood panel, the vertical bore communicating with the circular opening;

wherein the at least one fuse plate comprising a first opening disposed substantially in the middle of the at least one fuse plate; wherein the base comprising a second opening, such that the first opening, the second opening and the vertical bore are aligned, the first opening and the second opening receiving the proximal end;

wherein a pair of nuts threaded on the threaded bolt and disposed on either side of the at least one fuse plate abutting the at least one fuse plate.

* * * * *